US006817338B2

(12) United States Patent
Janic et al.

(10) Patent No.: US 6,817,338 B2
(45) Date of Patent: Nov. 16, 2004

(54) IDLE SPEED CONTROL SYSTEM

(75) Inventors: Dusan Janic, Columbus, IN (US); Chris Gilmore, Columbus, IN (US); R. Scott Malindzak, Mt. Pleasant, SC (US); Spencer C. Lewis, Jr., Mt. Pleasant, SC (US); Richard Newman, Charleston, SC (US)

(73) Assignee: Cummins, Inc., Columbus, IN (US)

( * ) Notice: Subject to any disclaimer, the term of this patent is extended or adjusted under 35 U.S.C. 154(b) by 71 days.

(21) Appl. No.: 10/066,897

(22) Filed: Feb. 4, 2002

(65) Prior Publication Data

US 2003/0145825 A1 Aug. 7, 2003

(51) Int. Cl.[7] ..... F02M 3/00
(52) U.S. Cl. ..... 123/339.19; 123/406.46
(58) Field of Search ..... 123/339.19, 339.16, 123/339.17, 339.18, 406.46, 357; 701/103, 110

(56) References Cited

U.S. PATENT DOCUMENTS

| | | | | |
|---|---|---|---|---|
| 4,125,039 A | | 11/1978 | Helm | |
| 4,252,096 A | * | 2/1981 | Kennedy | 123/370 |
| 4,616,613 A | | 10/1986 | Collonia | |
| 4,690,114 A | * | 9/1987 | Weischedel | 123/357 |
| 4,909,764 A | | 3/1990 | Hirukawa et al. | |
| 4,986,776 A | | 1/1991 | Hensel et al. | |
| 5,052,359 A | * | 10/1991 | Hardwick et al. | 123/406.45 |
| 5,480,364 A | | 1/1996 | Hilbert et al. | |
| 5,595,550 A | | 1/1997 | Jarvis et al. | |
| 5,619,966 A | * | 4/1997 | Aubourg et al. | 123/339.22 |
| 5,672,138 A | | 9/1997 | Mikami et al. | |
| 5,836,851 A | | 11/1998 | Ruman | |
| 5,957,994 A | * | 9/1999 | Meyer et al. | 701/110 |
| 6,026,784 A | | 2/2000 | Weisman et al. | |
| 6,102,755 A | | 8/2000 | Hoshiba | |
| 6,109,986 A | | 8/2000 | Gaynor et al. | |
| 6,173,696 B1 | * | 1/2001 | Fett et al. | 123/339.17 |
| 6,390,862 B1 | | 5/2002 | Eichinger | |
| 2003/0052486 A1 | | 3/2003 | Doll | |

FOREIGN PATENT DOCUMENTS

| | | |
|---|---|---|
| GB | 2340261 A | 2/2000 |
| JP | 10299549 A | 11/1998 |

* cited by examiner

*Primary Examiner*—Henry C. Yuen
*Assistant Examiner*—Arnold Castro
(74) *Attorney, Agent, or Firm*—Barnes & Thornburg

(57) ABSTRACT

A system and method are disclosed for controlling idle speed of an internal combustion engine. The system includes an engine speed sensor producing an engine speed signal indicative of a rotational engine speed of an internal combustion engine, and a control circuit. The control circuit controls the rotational speed of the engine between an idle speed reference and a maximum speed reference. The control circuit also modifies the idle speed reference as a function of the engine speed. Additionally, the control circuit may determine an engine acceleration rate as a function of the engine speed, and modify the idle speed reference as a function of the engine speed and the engine acceleration rate.

20 Claims, 5 Drawing Sheets

IDLE SPEED CONTROL SYSTEM

FIELD OF THE INVENTION

This invention relates generally to fueling control systems for internal combustion engines, and more particularly to an idle speed control system for an internal combustion engine.

BACKGROUND OF THE INVENTION

In certain applications utilizing an internal combustion engine, the engine may be subjected to a rapid load increase. If fueling remains constant in such a situation, the engine torque output will decrease, and the rotational speed of the engine will decrease. If the rotational speed of the engine falls below a threshold level, the engine could stall. In order to prevent an engine from stalling, most engine fueling control systems maintain a minimum engine speed, known as the idle speed.

In the past, the idle speed of an engine was controlled by an "idle screw" that physically prevented the throttle plate of the carburetor from closing, thereby ensuring that a minimum amount of fuel would be supplied to the engine. However, because this was an open loop system, increasing the load on the engine, even very gradually, would eventually cause the engine to stall. In modern electronic engine control systems, an engine speed sensor works in conjunction with a feedback controller to maintain a minimum engine speed, or idle speed. With this feedback control system, gradually increasing the load on the engine will not generally cause the engine to stall if engine speed is maintained above the idle speed. However, a rapid increase in the engine load may cause the engine speed to temporarily drop below the idle speed, thereby resulting in an engine stall.

One application where an internal combustion engine may be subjected to rapid increases in loading is in engine-driven pumping operations. For example, if the viscosity of the liquid being pumped increases suddenly, or the pump inlet becomes obscured, engine load may rapidly increase. Another example of an application where an engine may be subjected to rapid increases in loading is engine-driven electric generating sets. For example, where the generator is idling and a device requiring a large amount of current, such as an electric motor, is coupled to the generator, engine load may likewise increase rapidly.

One of the most common applications where engines are frequently subjected to extreme, rapid loading increases is a marine craft propulsion system. Marine craft, unlike land vehicles, generally do not have braking systems. Therefore, the operator of a marine craft decreases velocity by shifting into a drive mode opposite to the direction of travel. This same procedure is used irrespective of whether the marine craft is in forward drive mode or reverse drive mode.

Generally, marine propulsion systems are controlled by a system known as a "single lever control". Such single lever controls comprise a lever that is connected to both the speed control and the transmission of the marine propulsion system. The operation is such that in a neutral position, the transmission is held in neutral and the engine is maintained at its idle speed. When the control lever is shifted in one direction or the other from neutral, the transmission is engaged, typically via a clutch, in the forward drive mode or the reverse drive mode, while the engine is maintained at idle. If the operator continues to move the single lever control in the same direction, then the throttle is progressively opened, but only after the shifting has been completed.

This single lever control is very effective and easy to use for the operator. However, this type of system has disadvantages when the transmission is utilized to brake the travel of the marine craft. For example, if the marine craft has been traveling in one direction at some substantial speed, and the transmission is shifted into neutral, the marine craft will continue to move in that direction and the propeller will be rotated by the drag of the water. Furthermore, the engine speed will be returned to the idle speed.

Therefore, when the operator brakes the marine craft by immediately engaging the transmission to drive in a direction opposite the direction of travel, there will be a relatively high load placed on the engine, because it must overcome the drag on the propeller in order to reverse its direction of rotation. When the engine is operating at the idle speed, this drag on the propeller may be sufficient to cause a drop in engine speed sufficiently below the idle speed to result in an engine stall. Therefore, there is a need for a feature of a marine propulsion system to prevent stalling when the engine and transmission are used to brake vehicle travel.

Because marine propulsion systems are prone to stalling during these maneuvers, some methods exist in the prior art to prevent stalling when the engine and transmission are used to brake vehicle travel. One such method is disclosed in Hoshiba U.S. Pat. No. 6,102,755, granted Aug. 15, 2000, herein incorporated by reference. Hoshiba discloses a method for preventing stalling during the foregoing conditions wherein engine speed is increased above idle speed when a reversing of the direction of travel is detected. Hoshiba discloses a sensor for determining when the position of a single lever control changes from a position indicating travel in one direction to a position indicating travel in the opposite direction.

Another method to prevent stalling in a marine craft engine when a gear selection mechanism is moved from a neutral position to a forward or reverse position is disclosed in Ruman U.S. Pat. No. 5,836,851, granted Aug Nov. 17, 1998, herein incorporated by reference. Ruman discloses another method for preventing stalling during such conditions wherein the gain coefficients (factors) of a proportional, integral, and differential (PID) engine controller are changed to effectively increase the idle speed of the engine during gear selection mechanism articulation. Ruman discloses a sensor for determining a movement of the gear selection mechanism from a neutral position to a forward or reverse position, and the gain coefficients are modified when the sensor indicates such a movement.

While these and other prior art systems generally perform adequately for the applications for which they are designed, each requires the addition of a dedicated sensor for detecting the actuation of a control device, and a signal path between the sensor and an electronic engine controller that includes an interface for, and that is responsive to, signals from the sensor. Therefore, a need exists for a method to prevent stalling when an engine and transmission are used to brake vehicle travel that does not require additional sensors, such as for sensing the actuation of a control device.

Some applications where an engine is subjected to rapid increases in loading, such as those mentioned above, are not in response to the actuation of a control device, but rather are due to a change in operating conditions. In these applications, stalling cannot be prevented by the methods disclosed in Hoshiba, Ruman, or by other prior art systems, because there is no control device responsible for the load increase to which a sensor may be attached. Therefore, in these applications, a need also exists for a method to prevent stalling.

SUMMARY OF THE INVENTION

According to one aspect of the invention, a system is provided for controlling idle speed of an internal combustion engine. The system comprises an engine speed sensor producing an engine speed signal indicative of a rotational engine speed of an internal combustion engine. The control circuit controls the rotational speed of the engine between an idle speed reference and a maximum speed reference. The control circuit also modifies the idle speed reference as a function of the engine speed.

Illustratively according to this aspect of the invention, the control circuit increases the idle speed reference from a first idle speed value to a second higher idle speed value as a function of the engine speed signal.

Further illustratively according to this aspect of the invention, the control circuit increases the idle speed reference to the second idle speed value if said engine speed signal indicates a rotational engine speed greater than a threshold engine speed value for at least a first predefined time period.

Further illustratively according to this aspect of the invention, the control circuit increases the idle speed reference to the second idle speed value if the engine speed signal indicates a rotational engine speed less than the threshold engine speed subsequent to indicating for at least the first predefined time period a rotational engine speed greater than the threshold engine speed.

Further illustratively according to this aspect of the invention, the control circuit decreases the idle speed reference from the second idle speed value to the first idle speed upon the expiration of a second predefined time period.

Further illustratively according to this aspect of the invention, the control circuit decreases the idle speed reference from the second idle speed value to the first idle speed at a predetermined rate.

Alternatively illustratively according to this aspect of the invention, the control circuit includes an engine speed control strategy. The engine speed control strategy comprises a means for generating a reference engine speed as a function of a torque request, a means for generating the idle speed reference, a means for generating the maximum speed reference, and a speed governor configured to control the rotational engine speed of the engine between the idle speed reference and the maximum speed reference. The means for generating the idle speed reference is responsive to the engine speed signal to modify the idle speed reference.

According to another aspect of the invention, a method is provided for controlling minimum rotational speed of an internal combustion engine. The method comprises the steps of determining a rotational engine speed of an internal combustion engine, determining an engine acceleration rate as a function of the rotational engine speed of the engine, and controlling a minimum rotational speed of the engine as a function of the rotational engine speed of the engine and the engine acceleration rate.

Illustratively according to this aspect of the invention, controlling the minimum rotational speed of the engine includes increasing the minimum rotational speed from a first speed value to a second higher speed value if the rotational engine speed is greater than a threshold speed value and the engine acceleration rate is less than a predefined engine acceleration rate.

Further illustratively according to this aspect of the invention, controlling the minimum rotational speed of the engine includes increasing the minimum rotational speed from the first speed value to the second higher speed value if the rotational engine speed is greater than the threshold speed value for at least a first predefined time period.

Further illustratively according to this aspect of the invention, controlling the minimum rotational speed of the engine includes decreasing the minimum rotational speed from the second speed value to the first speed value upon the expiration of a second predefined time period.

Further illustratively according to this aspect of the invention, controlling the minimum rotational speed of the engine includes decreasing the minimum rotational speed from the second speed value to the first speed value at a predetermined rate.

According to another aspect of the invention, a system is provided for controlling idle speed of an internal combustion engine. The system comprises an engine speed sensor producing an engine speed signal indicative of rotational speed of an internal combustion engine, and a control circuit controlling the rotational speed of the engine between an idle speed reference and a maximum speed reference. The control circuit temporarily increases the idle speed reference from a first idle speed value to a second higher idle speed value if the engine speed signal drops from a threshold rotational speed value.

Illustratively according to this aspect of the invention, the control circuit is increases the idle speed reference from the first idle speed value to the second idle speed value for a predefined time period.

Further illustratively according to this aspect of the invention, the control circuit returns the idle speed reference to the first idle speed value upon expiration of the predefined time period.

According to another aspect of the invention, a method is provided for controlling idle speed of an internal combustion engine. The method comprises the steps of determining a rotational speed of an internal combustion engine, controlling the rotational speed of the engine between an idle speed reference and a maximum speed reference, and temporarily increasing the idle speed reference from a first idle speed value to a second greater idle speed value if the rotational speed drops from a threshold rotational speed value.

Illustratively according to this aspect of the invention, temporarily increasing the idle speed reference includes increasing the idle speed reference from the first idle speed value to the second idle speed value if the rotational speed is greater than the threshold rotational speed value for at least a first predefined time period.

Further illustratively according to this aspect of the invention, temporarily increasing the idle speed reference includes decreasing the idle speed reference from the second idle speed value to the first idle speed value upon the expiration of a second predefined time period.

Further illustratively according to this aspect of the invention, temporarily increasing the idle speed reference includes decreasing the idle speed reference from the second idle speed value to the first idle speed value at a predetermined rate.

Further illustratively according to this aspect of the invention, the first predefined time period is approximately ten seconds and the second predefined time period is approximately four seconds.

DETAILED DESCRIPTION OF A PREFERRED EMBODIMENT

Illustrative embodiments of a system for temporarily adjusting the idle speed of an internal combustion engine are herein described. It will be appreciated by those skilled in the art that the device is useful in applications and embodiments differing from the description that follows.

Figure 1:
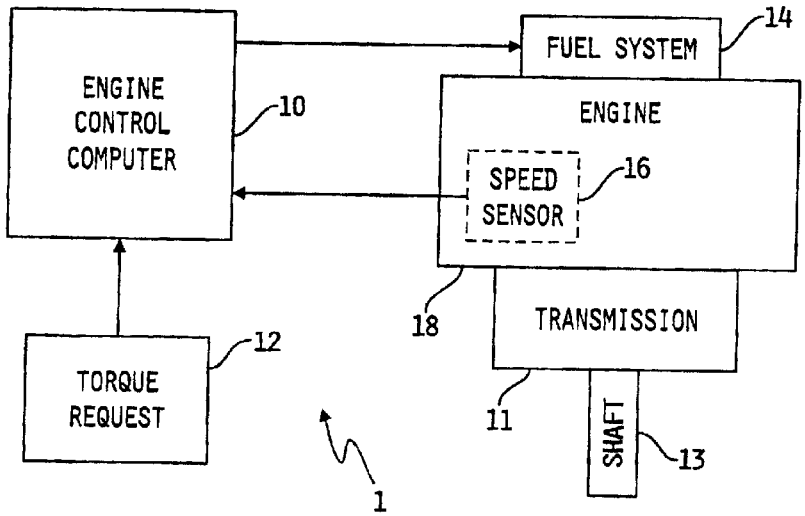
FIG. 1 is a block diagram illustrating one preferred embodiment of an engine control system, in accordance with the present invention.

Referring now generally to FIG. 1, an engine control system 1 is shown including one preferred embodiment of the present invention. Engine control system 1 includes: engine control computer 10, torque request device 12, fueling system 14, internal combustion engine 18, engine speed sensor 16, transmission 11, and output shaft 13. Engine control computer 10 for controlling and managing the overall operation of engine 18 may be one of the many types of known control computers adapted for use with internal combustion engines, which are often referred to as electronic control modules (ECMs). Torque request device 12 may be any known torque request device, such as a hand controlled throttle, accelerator pedal, cruise control system, or the like, as is well known in the art. In one illustrative embodiment, torque request device 12 is a single lever control. Fueling system 14 may be an electronically controlled fueling system of known configuration.

Engine 18 may be any known type and is, in one illustrative embodiment, a diesel engine, although it is to be understood that the invention could be practiced with engines of the spark ignited type as well. Engine 18 includes engine speed sensor 16, which is operably coupled to control computer 10. Engine speed sensor 16 is preferably a Hall effect sensor operable to sense passage thereby of a number of teeth formed on a gear or tone wheel rotating synchronously with the crank shaft (not shown) of engine 18. Alternatively, sensor 16 may be a variable reluctance or other known sensor, and is in any case operable to provide an engine speed signal to control computer 10 indicative of rotational speed of engine 18.

In some embodiments, such as vehicular applications, transmission 11 is mechanically coupled between the engine 18 and shaft 13. In other embodiments, such as electric generator sets, engine 18 is coupled directly to shaft 13. However, the presence or absence of transmission 11 does impact the overall operation of engine control system 1. Transmission 11 may be a transmission of any known type that provides for torque conversion and/or change of shaft 13 rotation direction. In some of these embodiments, transmission 11 contains a transmission control computer (not shown) operable to control transmission 11, as is well known on the art. In these embodiments, engine control computer 10 may be operably coupled to the transmission control computer via suitable data transmission path in order to coordinate engine control with transmission control.

Shaft 13 is coupled between either transmission 11 (if present) or engine 18, and the load (not shown). The load could be a marine propulsion screw or propeller, an electric generator, a drive axle, or any other load capable of being driven by rotational force.

In operation, control computer 10 is operatively connected to torque request device 12 and to fueling system 14, wherein control computer 10 is responsive to at least a torque request signal from device 12 to provide a fueling signal to fueling system 14 indicative of the torque request in a manner well known in the art. Fueling system 14 is, in turn, responsive to the fueling signal to supply a quantity of fuel to engine 18.

Figure 2:
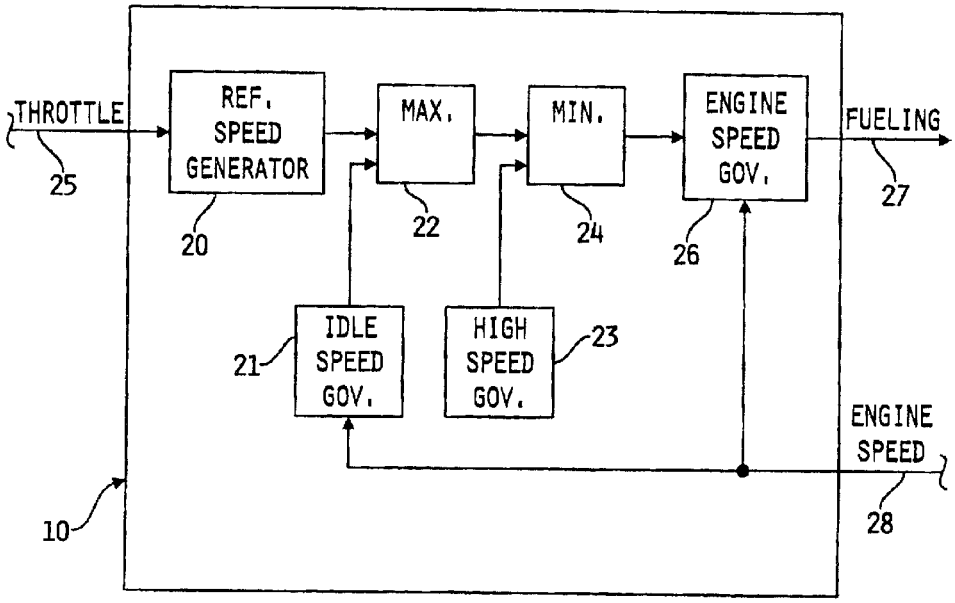
FIG. 2 is a block diagram illustrating one preferred embodiment of an electronic control computer, in accordance with the present invention.

Turning to FIG. 2, the description of the control and communications functions implemented in one preferred embodiment will now be described. First, the operation of engine control system 1 will be described without the idle speed control strategy of the present invention. Afterwards, the idle speed control strategy of the present invention will be described as it relates to engine control system 1.

As is known in the art, data regarding the fueling, power, torque, and other characteristics of engine 18 are programmed into control computer 10. In order to manipulate the output engine speed of engine 18, the torque request signal on signal path 25 is provided by torque request device 12 to control computer 10. In one preferred embodiment, the torque request signal on signal path 25 represents a percentage value corresponding to a percent control lever deflection. In the embodiment shown, control computer 10 includes a reference speed governor 20, which correlates the torque request signal on signal path 25 to a reference engine speed value. Control computer 10 further includes idle speed governor 21, which produces a value indicative of the minimum engine speed (the idle speed). In known prior art systems, the idle speed is a fixed value that is typically programmed into control computer 10 via a service tool (not shown) of known construction Control computer 10 further includes maximum function block 22. Maximum function block 22 receives a reference engine speed value from reference speed generator 20, and also receives the idle speed value from idle speed governor 21. Maximum function block 22 generates an engine speed reference value equal to the maximum of the reference engine speed and the idle engine speed values. Control computer 10 further includes minimum function block 24. Minimum function block 24 receives engine reference speed value from maximum function block 22 as one input, and a maximum engine speed value from high speed governor 23, which is indicative of the maximum desirable engine speed. Minimum function block 24 generates a final reference speed value that is equal to the lesser of the value output by maximum function block 22 and the value output by the high speed governor 23.

Control computer 10 further includes engine speed governor 26. Engine speed governor 26 receives the value output by minimum function block 24, which represents a desired engine speed, and the engine speed signal on signal path 28 from engine speed sensor 16, which represents the actual engine speed. Engine speed governor 26 calculates the fueling signal on signal path 27 as a function of the desired engine speed and actual engine speed. This fueling signal is selected so as to drive the engine speed error (desired engine speed—actual engine speed) to zero. The fueling signal is provided by engine speed governor 26 to fuel system 14, which responds by decreasing, maintaining, or increasing the amount of fuel supplied to engine 18 accordingly.

In accordance with the present invention, the engine speed signal on signal path 28 is further provided as an input to idle speed governor 21, as will be described in greater detail hereafter with reference to FIGS. 3, 4, 5 and 6. Idle speed governor 21 is configured to control the idle speed value provided to minimum function block 22 as a function of engine speed under certain operating conditions.

Figure 3:
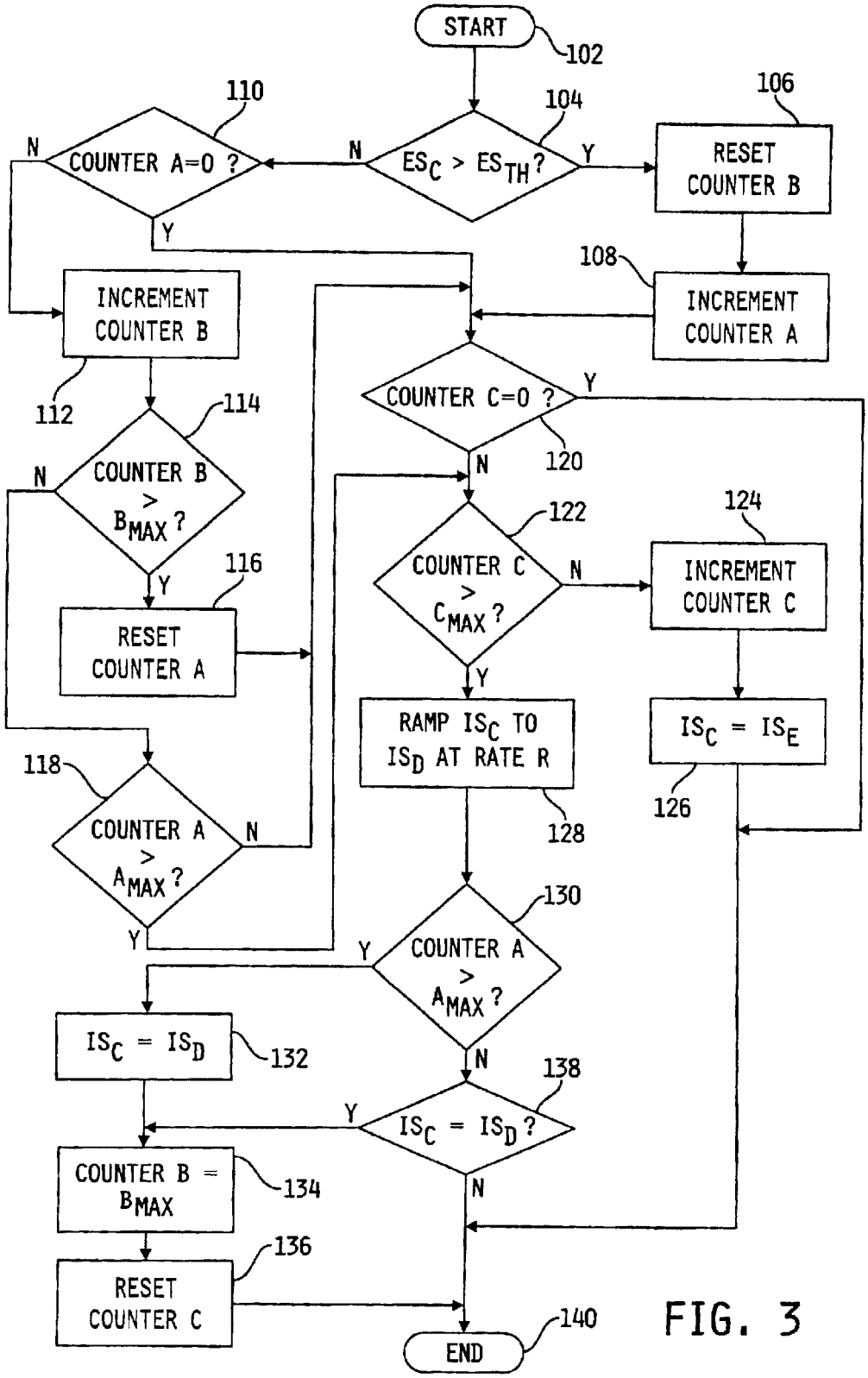
FIG. 3 is a flowchart illustrating one embodiment of a software algorithm for controlling the idle speed of an internal combustion engine, in accordance with the present invention.

Turning to FIG. 3, on preferred embodiment of the idle speed control strategy of the present invention will now be described. FIG. 3 is a flow chart illustrating one embodiment of a software algorithm for controlling the idle speed of an internal combustion engine, wherein the algorithm is stored within a memory of control computer 10. It will be obvious to those skilled in the art that other algorithms could be used to perform the same function without departing from the spirit or the scope of the present invention.

In one preferred embodiment, the algorithm is implemented inside idle speed governor 21. However, the algorithm could be implemented in any computational device coupled to control computer 10, such as a transmission control computer (not shown), without departing from the scope of the present invention.

A number of variables are utilized in the algorithm of FIG. 3. The idle increase enable counter, Counter A, represents the amount of time that the current engine speed ($ES_C$) is above the threshold engine speed ($ES_{TH}$). The idle increase disable counter, Counter B, represents the amount of time that the current engine speed ($ES_C$) is below the threshold engine speed ($ES_{TH}$). The idle increase reference counter, Counter C, represents the amount of time that the current idle speed ($IS_C$) is elevated.

At some point in the variable initialization phase (not shown) of control computer 10, the current idle speed ($IS_C$) is set equal to the default idle speed ($IS_D$). It has been found that a suitable default idle speed is between 400 and 500 RPM for marine craft where engine 18 is a diesel engine. However, a suitable default idle speed will vary from engine to engine, and from application to application. Also during the variable initialization phase (not shown) of control computer 10, the three Counters A, B and C are reset (set equal to zero).

The algorithm of FIG. 3 is an endless loop, which begins at step 102. At step 104, control computer 10 reads the engine speed signal on signal path 28, as explained above in the description of FIG. 2, and determines whether the current engine speed ($ES_C$) is greater than a threshold engine speed ($ES_{TH}$). If the engine speed is greater than the threshold engine speed, the algorithm progresses to step 106. However, if the engine speed is not greater than the threshold engine speed, the algorithm progresses to step At step 106, control computer 10 resets Counter B to zero. At step 108, control computer 10 increments Counter A. Counter A indicates the amount of time that the current engine speed ($ES_C$) has been above the threshold engine speed ($ES_{TH}$). The algorithm next progresses to step 120, which is described below.

At step 110, control computer 10 determines whether Counter A is equal to zero. If Counter A is equal to zero, the algorithm progresses to step 120, which is described below. However, if Counter A is not equal to zero, the algorithm progresses to step 112. At step 112, control computer 10 increments Counter B. Counter B represents the amount of time that the current engine speed ($ES_C$) has been below the threshold engine speed ($ES_{TH}$).

At step 114, control computer 10 determines whether Counter B is greater than its time-out value ($B_{MAX}$). If Counter B is greater than its time-out value, the algorithm progresses to step 116. At step 116, control computer 10 resets Counter A to zero. The algorithm then progresses to step 120, which is described below. If Counter B is not greater than its time-out value, the algorithm progresses to step 118.

At step 118, control computer 10 determines whether Counter A is greater than its time-out value ($A_{MAX}$). If Counter A is greater than its time-out value, the algorithm progresses to step 122, which is described below. If Counter A is not greater than its timeout value, the algorithm progresses to step 120.

At step 120, control computer 10 determines whether Counter C is equal to zero. If Counter C is equal to zero, the algorithm progresses to end step 140, and the algorithm repeats. However, if Counter C is not equal to zero, the algorithm progresses to step 122. At step 122 control computer 10 determines whether Counter C is greater than its time-out value ($C_{MAX}$). If Counter C is greater than its time-out value, the algorithm progresses to step 128, which is described below. If Counter C is not greater than its time-out value, the algorithm progresses to step 124.

At step 124, control computer 10 increments Counter C. Counter C indicates the amount of time the current Idle speed ($IS_C$) has been elevated. The algorithm next progresses to step 126, where control computer 10 sets the current idle speed ($IS_C$) equal to the elevated idle speed ($IS_E$). It has been found that a suitable elevated idle speed is about 1000 RPM for marine craft where engine 18 is a diesel engine. However, a suitable elevated idle speed may vary from engine to engine and from application to application. This elevated idle speed will now be the idle speed value provided to by idle speed governor 21 to maximum function block 22, as described above in the description of FIG. 2. After step 126, the algorithm progresses to end step 140, and repeats.

At step 128, control computer 10 ramps the current idle speed ($IS_C$) down from the elevated idle speed ($IS_E$) towards the default idle speed ($IS_D$) at a suitable rate R. It has been determined that one suitable rate R is approximately 50 revolutions per minute (RPM) per second. However, this rate may vary from engine to engine and from application to application.

At step 130, control computer 10 determines whether Counter A is greater than its time-out value ($A_{MAX}$). If Counter A is greater than its time-out value, the algorithm progresses to step 132, which is described below. If Counter A is not greater than its timeout value, the algorithm progresses to step 138. At step 138, control computer 10 determines whether the current idle speed ($IS_C$) has been ramped down to (is equal to) the default idle speed ($IS_D$). If the current idle speed ($IS_C$) is not equal to the default idle speed ($IS_D$), the algorithm progresses to end step 140, and repeats. If the current idle speed ($IS_C$) is equal to the default idle speed ($IS_D$), the algorithm progresses to step 134, which is described below.

At step 132, control computer 10 sets the current idle speed ($IS_C$) equal to the default idle speed ($IS_D$). At step 134, control computer 10 sets Counter B equal to its timeout value ($B_{MAX}$). At step 136, control computer 10 resets Counter C to zero. The algorithm then progresses to end step 140, and repeats.

Figure 4:
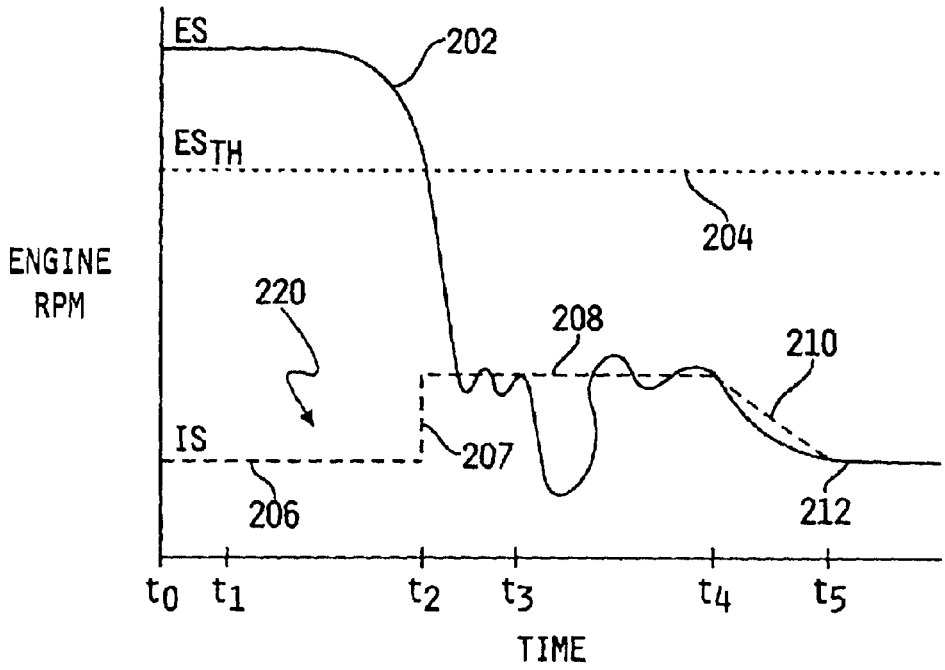
FIG. 4 is a graph representing engine revolutions per minute with respect to time of an illustrative embodiment of the present invention in a marine propulsion system application.

Turning to FIG. 4, illustrative plots with respect to time of the engine speed (ES), threshold engine speed ($ES_{TH}$), and idle speed (IS) in RPM for one illustrative embodiment are shown. In this illustrative embodiment, the idle speed being controlled is that of an engine used in a marine craft propulsion system. The description that follows is for illustration only, and is not intended to limit the invention in any way.

Plot line 202 represents the engine speed with respect to time. Plot line 204 represents the threshold engine speed with respect to time. Plot line 220 represents the idle speed with respect to time, and is separated into five sections. Section 206 of idle speed plot line 220 represents the default idle speed ($IS_D$). Section 207 of idle speed plot line 220 represents the instantaneous increase of engine idle speed from the default idle speed ($IS_D$) to the elevated idle speed ($IS_E$). Section 208 of idle speed plot line 220 represents the elevated idle speed ($IS_E$). Section 210 of idle speed plot line 220 represents the ramping down of the idle speed from the elevated idle speed ($IS_E$) to the default idle speed ($IS_D$) at a constant rate R. Section 212 of idle speed plot line 220 represents the default idle speed ($IS_D$), and is the same speed as represented by section 206.

At time $t_0$, the algorithm of FIG. 3 is at step 104, and engine 18 is operating at an engine speed above the threshold engine speed represented by plot line 204. Also at time $t_0$, control computer 10 determines the engine speed at step 104. In this illustrative example, at time $t_0$ the engine speed is greater than the threshold engine speed, so the algorithm progresses to step 104, where control computer 10 resets Counter B to zero. Next, the algorithm progresses to step 108, where control computer 10 increments Counter A. At step 120, control computer 10 determines whether Counter C is equal to zero. In this illustrative example, Counter C is equal to zero, because the idle speed has not been elevated. Therefore, the algorithm progresses to end step 140, and repeats.

Between time $t_0$ and time $t_1$, control computer 10 repeatedly executes steps 102, 104, 106, 108, 120 and 140 of the algorithm. At time $t_1$, Counter A times out (becomes greater than $A_{max}$). Between time $t_1$ and time $t_2$, control computer 10 continues executing these six steps.

At time $t_2$, the engine speed falls to the threshold engine speed represented by plot line 204. Also at time $t_2$, control computer 10 determines the engine speed at step 104. In this illustrative example, at time $t_2$ the engine speed is not greater than the threshold engine speed, so the algorithm progresses to step 110. At step 110, control computer 10 determines whether Counter A is equal to zero. In this illustrative example, Counter A is not equal to zero, so the algorithm progresses to step 112, where computer 10 increments Counter B. At step 114, control computer 10 determines whether Counter B has timed-out (is greater than $B_{max}$). In this illustrative example, Counter B has not timed-out, so the algorithm progresses to step 118. At step 118, computer 10 determines whether Counter A has timed-out (is greater than $A_{max}$). In this illustrative example, Counter A has timed-out, so the algorithm progresses to step 122.

Continuing at time $t_2$, at step 122 control computer 10 determines whether Counter C has timed-out (is greater than $C_{max}$). In this illustrative example, the idle speed has not yet been elevated at time $t_2$, so counter C has not timed-out. Therefore, the algorithm progresses to step 124, where control computer 10 increments Counter C. At step 126, control computer 10 elevates the idle speed by setting the current idle speed ($IS_C$) equal to the elevated idle speed ($IS_E$). The algorithm then progresses to end step 140, and repeats.

The oscillations occurring where engine speed plot line 202 crosses idle speed plot line 220 are the result of a change in the transmission gearing from a forward gear to a reverse gear. The large dip in plot line 202 occurring after these oscillations is the result of the clutch engaging, and it is at this point that engine 18 experiences the most significant load increases. As can be seen in the illustrative plots of FIG. 4, if idle speed were not set to the elevated idle speed at the time the clutch engaged, the engine speed would decrease to near zero, and could stall. By raising the idle speed under the specified conditions, the present invention provides sufficient idle speed "room" such that the clutch-induced engine speed dip can occur without stalling the engine.

Between time $t_2$ and time $t_3$, control computer 10 repeatedly executes steps 102, 110, 112, 114, 118, 122, 124, 126 and 140 of the algorithm. At time $t_3$, Counter B times out (becomes greater than $B_{max}$), changing the execution of the algorithm as described below.

At time $t_3$, control computer 10 determines the engine speed at step 104. In this illustrative example, at time $t_2$ the engine speed is not greater than the threshold engine speed, so the algorithm progresses to step 110. At step 110, control computer 10 determines whether Counter A is equal to zero. In this illustrative example, Counter A is not equal to zero, so the algorithm progresses to step 112, where computer 10 increments Counter B. At step 114, control computer 10 determines whether Counter B has timed-out (is greater than $B_{max}$). Here, at time $t_3$, Counter B has timed-out, so the algorithm progresses to step 116. At step 116, computer 10 resets Counter A to zero, and then the algorithm progresses to step 120. At step 120, control computer 10 determines whether Counter C is equal to zero. At time $t_3$, the idle speed has been elevated for some period of time, so Counter C is not equal to zero. Therefore, the algorithm progresses to step 122.

Continuing at time $t_3$, at step 122 control computer 10 determines whether Counter C has timed-out (is greater than $C_{max}$). In this illustrative example, counter C does not time-out until time $t_4$. Therefore, the algorithm progresses to step 124, where computer 10 increments Counter C. At step 126, control computer 10 elevates the idle speed by setting the current idle speed ($IS_C$) equal to the elevated idle speed ($IS_E$). The algorithm then progresses to end step 140, and repeats.

The second iteration of the algorithm after $t_3$ is different, because Counter A is reset to zero during the first iteration after $t_3$. Therefore, from the second iteration following $t_3$ until the first iteration following $t_4$ the algorithm progresses as follows. First, control computer 10 determines the engine speed at step 104. The engine speed is not greater than the threshold engine speed, so the algorithm progresses to step 110. At step 110, control computer 10 determines that Counter A is now equal to zero, so the algorithm progresses to step 120. At step 120, control computer 10 determines that Counter C is equal to zero, so the algorithm progresses to step 122.

Continuing in the second iteration of the algorithm after $t_3$, at step 122 control computer 10 determines whether Counter C has timed-out (is greater than $C_{max}$). In this illustrative example, counter C does not time-out until time $t_4$. Therefore, the algorithm progresses to step 124, where control computer 10 increments Counter C. At step 126, control computer 10 elevates the idle speed by setting the current idle speed ($IS_C$) equal to the elevated idle speed ($IS_E$). The algorithm then progresses to end step 140, and repeats.

At time $t_4$, Counter C times out (becomes greater than $C_{max}$), and the algorithm progresses as follows. At time $t_4$, control computer 10 determines the engine speed at step 104. In this illustrative example, at time $t_2$ the engine speed is not greater than the threshold engine speed, so the algorithm progresses to step 110. At step 110, control computer 10 determines whether Counter A is equal to zero. In this illustrative example, Counter A is equal to zero, so the algorithm progresses to step 120. At step 120, control computer 10 determines whether Counter C is equal to zero. In this illustrative example, at time $t_4$ Counter C is not equal to zero, so the algorithm progresses to step 122.

Continuing at time $t_4$, at step 122 control computer 10 determines whether Counter C has timed-out (is greater than $C_{max}$). In this illustrative example, counter C times-out at time $t_4$, so the algorithm progresses to step 128. At step 128, computer 10 ramps the current idle speed ($IS_C$) down from the elevated idle speed ($IS_E$) towards the default idle speed ($IS_D$) at rate R. Of course, R need not be a linear function; any curve that gradually returns the idle speed to the default idle speed may be implemented. A linear function is shown only for ease of illustration.

Continuing at time $t_4$, at step 130, computer 10 determines whether Counter A has timed-out (is greater than $A_{max}$). In this illustrative example, Counter A is equal to zero at time $t_4$, so the algorithm progresses to step 138. At step 138, control computer 10 determines whether the current idle speed ($IS_C$) is equal to the default idle speed ($IS_D$). In this illustrative example, the current idle speed ($IS_C$) is not equal to the default idle speed ($IS_D$) at time $t_4$. Therefore, the algorithm then progresses to end step 140, and repeats.

Between time $t_4$ and time $t_5$, control computer 10 repeatedly executes steps 102, 110, 120, 122, 128, 130, 138 and 140 of the algorithm. At time $t_5$, the current idle speed ($IS_C$) has ramped down to the default idle speed ($IS_D$) value, changing the execution of the algorithm as described below.

At time $t_5$, control computer 10 determines the engine speed at step 104. In this illustrative example, at time $t_5$ the engine speed is not greater than the threshold engine speed, so the algorithm progresses to step 110. At step 110, control computer 10 determines whether Counter A is equal to zero. In this illustrative example, Counter A is equal to zero, so the algorithm progresses to step 120. At step 120, control computer 10 determines whether Counter C is equal to zero. In this illustrative example, at time $t_5$ Counter C is not equal to zero, so the algorithm progresses to step 122.

Continuing at time $t_5$, at step 122 control computer 10 determines whether Counter C has timed-out (is greater than $C_{max}$). Because counter C has timed-out, the algorithm progresses to step 128. At step 128, control computer 10 ramps the current idle speed ($IS_C$) down from the elevated idle speed ($IS_E$) towards the default idle speed ($IS_D$) at rate R. At step 130, computer 10 determines whether Counter A has timed-out (is greater than $A_{max}$). In this illustrative example, Counter A is equal to zero at time $t_5$, so the algorithm progresses to step 138. At step 138, control computer 10 determines whether the current idle speed ($IS_C$) is equal to the default idle speed ($IS_D$). In this illustrative example, the current idle speed ($IS_C$) is equal to the default idle speed ($IS_D$) at time $t_5$. Therefore, the algorithm progresses to step 134. At step 134, control computer 10 sets Counter B equal to $B_{max}$, putting it in the "timed-out" state. At step 136, control computer 10 resets Counter C to zero. The algorithm then progresses to end step 140, and repeats.

Figure 5:
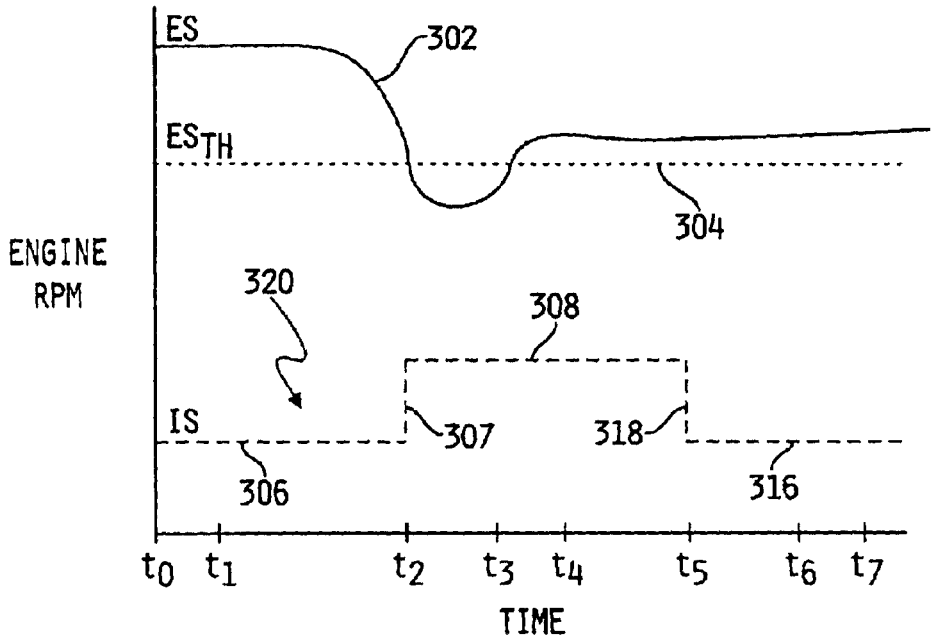
FIG. 5 is a graph representing engine revolutions per minute with respect to time of an illustrative embodiment of the present invention in a marine propulsion system application.

Turning to FIG. 5, a second example using illustrative plots with respect to time of the engine speed (ES), threshold engine speed ($ES_{TH}$), and idle speed (IS) in RPM for the same illustrative embodiment is shown. In this example, the idle speed being controlled is again that of an engine used in a marine craft propulsion system. The description that follows is for illustration only, and is not intended to limit the invention in any way.

Plot line 302 represents the engine speed with respect to time. Plot line 304 represents the threshold engine speed with respect to time. Plot line 320 represents the idle speed with respect to time, and is separated into five sections. Section 306 of idle speed plot line 320 represents the default idle speed ($IS_D$). Section 307 of idle speed plot line 320 represents an instantaneous increase of engine idle speed from the default idle speed ($IS_D$) to the elevated idle speed ($IS_E$). Section 308 of idle speed plot line 220 represents the elevated idle speed ($IS_E$). Section 318 of idle speed plot line 220 represents an instantaneous decrease of engine idle speed from the elevated idle speed ($IS_E$) to the default idle speed ($IS_D$). Section 316 of idle speed plot line 220 represents the default idle speed ($IS_D$), and is the same speed as represented by sections 306.

At time to, the algorithm of FIG. 3 is at step 104, and engine 18 is operating at an engine speed above the threshold engine speed represented by plot line 204. Also at time $t_0$, control computer 10 determines the engine speed at step 104. In this illustrative example, at time $t_0$ the engine speed is greater than the threshold engine speed, so the algorithm progresses to step 104, where control computer 10 resets Counter B to zero. Next, the algorithm progresses to step 108, where control computer 10 increments Counter A. At step 120, control computer 10 determines whether Counter C is equal to zero. In this illustrative example, Counter C is equal to zero, because the idle speed has not been elevated. Therefore, the algorithm progresses to end step 140, and repeats.

Between time $t_0$ and time $t_1$, control computer 10 repeatedly executes steps 102, 104, 106, 108, 120 and 140 of the algorithm. At time $t_1$, Counter A times out (becomes greater than $A_{max}$). Between time $t_1$ and time $t_2$, control computer 10 continues executing these six steps.

At time $t_2$, the engine speed falls to the threshold engine speed represented by plot line 204. Also at time $t_2$, control computer 10 determines the engine speed at step 104. In this illustrative example, at time $t_2$ the engine speed is not greater than the threshold engine speed, so the algorithm progresses to step 110. At step 110, control computer 10 determines whether Counter A is equal to zero. In this illustrative example, Counter A is not equal to zero, so the algorithm progresses to step 112, where computer 10 increments Counter B. At step 114, control computer 10 determines whether Counter B has timed-out (is greater than $B_{max}$). In this illustrative example, Counter B has not timed-out, so the algorithm progresses to step 118. At step 118, computer 10 determines whether Counter A has timed-out (is greater than $A_{max}$). In this illustrative example, Counter A has timed-out, so the algorithm progresses to step 122.

Continuing at time $t_2$, at step 122 control computer 10 determines whether Counter C has timed-out (is greater than $C_{max}$). In this illustrative example, the idle speed has not yet been elevated at time $t_2$, so counter C has not timed-out. Therefore, the algorithm progresses to step 124, where control computer 10 increments Counter C. At step 126, control computer 10 elevates the idle speed by setting the current idle speed ($IS_C$) equal to the elevated idle speed ($IS_E$). The algorithm then progresses to end step 140, and repeats.

Between time $t_2$ and time $t_3$, control computer 10 repeatedly executes steps 102, 110, 112, 114, 118,122,124,126 and 140 of the algorithm. At time $t_3$, the engine speed rises to the threshold engine speed represented by plot line 204, changing the execution of the algorithm as described below.

At time $t_3$, control computer 10 determines the engine speed at step 104. In this illustrative example, at time $t_3$ the engine speed is greater than the threshold engine speed, so the algorithm progresses to step 106. At step 106, control computer 10 resets Counter B to zero. Next, the algorithm progresses to step 108, where control computer 10 increments Counter A. At step 120, control computer 10 determines whether Counter C is equal to zero. In this illustrative example, Counter C is not equal to zero, because the idle speed has already been elevated. Therefore, the algorithm progresses to step 122.

Continuing at time $t_3$, at step 122 control computer 10 determines whether Counter C has timed-out (is greater than $C_{max}$). In this illustrative example, counter C does not timeout until time $t_5$. Therefore, the algorithm progresses to step 124, where control computer 10 increments Counter C. At step 126, control computer 10 elevates the idle speed by setting the current idle speed ($IS_C$) equal to the elevated idle speed ($IS_E$). The algorithm then progresses to end step 140, and repeats.

Between time $t_3$ and time $t_4$, control computer 10 repeatedly executes steps 102, 106, 108, 120, 122, 124, 126 and 140 of the algorithm. At time $t_4$, Counter A times out (becomes greater than $A_{max}$). Nevertheless, control computer 10 continues repeatedly executing steps 102, 106, 108,120, 122, 124,126 and 140 of the algorithm until Counter C times-out at time $t_5$, changing the execution of the algorithm as described below.

At time $t_5$, control computer 10 determines the engine speed at step 104. In this illustrative example, at time $t_5$ the engine speed is greater than the threshold engine speed, so the algorithm progresses to step 106. At step 106, control computer 10 resets Counter B to zero. Next, the algorithm progresses to step 108, where control computer 10 increments Counter A. At step 120, control computer 10 determines whether Counter C is equal to zero. In this illustrative example, at time $t_5$ Counter C is not equal to zero, so the algorithm progresses to step 122.

Continuing at time $t_5$, at step 122 control computer 10 determines whether Counter C has timed-out (is greater than $C_{max}$). In this illustrative example, counter C does is timed-out at time $t_5$, so the algorithm progresses to step 128. At step 128, computer 10 ramps the current idle speed ($IS_C$) down from the elevated idle speed ($IS_E$) towards the default idle speed ($IS_D$) at rate R. As will be described below, step 128 is only executed one time in this illustrative example, so the current idle speed ($IS_C$) will not decrease appreciably before control computer 10 sets it to the default idle speed ($IS_D$) in step 132.

At step 130, computer 10 determines whether Counter A has timed-out (is greater than $A_{max}$). In this illustrative example, Counter A is timed-out at time $t_5$, so the algorithm progresses to step 132. At step 132, control computer 10 sets the current idle speed ($IS_C$) equal to the default idle speed ($IS_D$). This is done because Counter A has timed-out, indicating that the engine speed (ES) has been above the threshold engine speed ($ES_{TH}$) long enough that an elevated idle speed is no longer necessary. The algorithm then progresses to step 134. At step 134, control computer 10 sets Counter B equal to $B_{max}$, putting it in the "timed-out" state. At step 136, control computer 10 resets Counter C to zero. The algorithm then progresses to end step 140, and repeats.

In the illustrative example explained above with reference to FIG. 5, the engine speed (ES) is above the threshold engine speed ($ES_{TH}$) when Counter C times-out. Therefore, ramping the current idle speed ($IS_C$) gradually down to the default idle speed ($IS_D$) is unnecessary, because the engine speed (ES) is not being controlled by the current idle speed ($IS_C$). Rather, the engine speed is being controlled the torque request signal on signal path 25 (shown in FIG. 2).

Similar to the example shown in FIG. 5, if the engine speed is decreased gradually enough, then the elevated idle speed ($IS_E$) will never affect the engine speed. This is because the current idle speed ($IS_C$) will ramped down to the default idle speed ($IS_D$) before the engine speed reaches the idle speed. It is only in situations where the engine speed falls at a sufficiently rapid rate that the elevated idle speed ($IS_E$) affects the engine speed.

Figure 6:
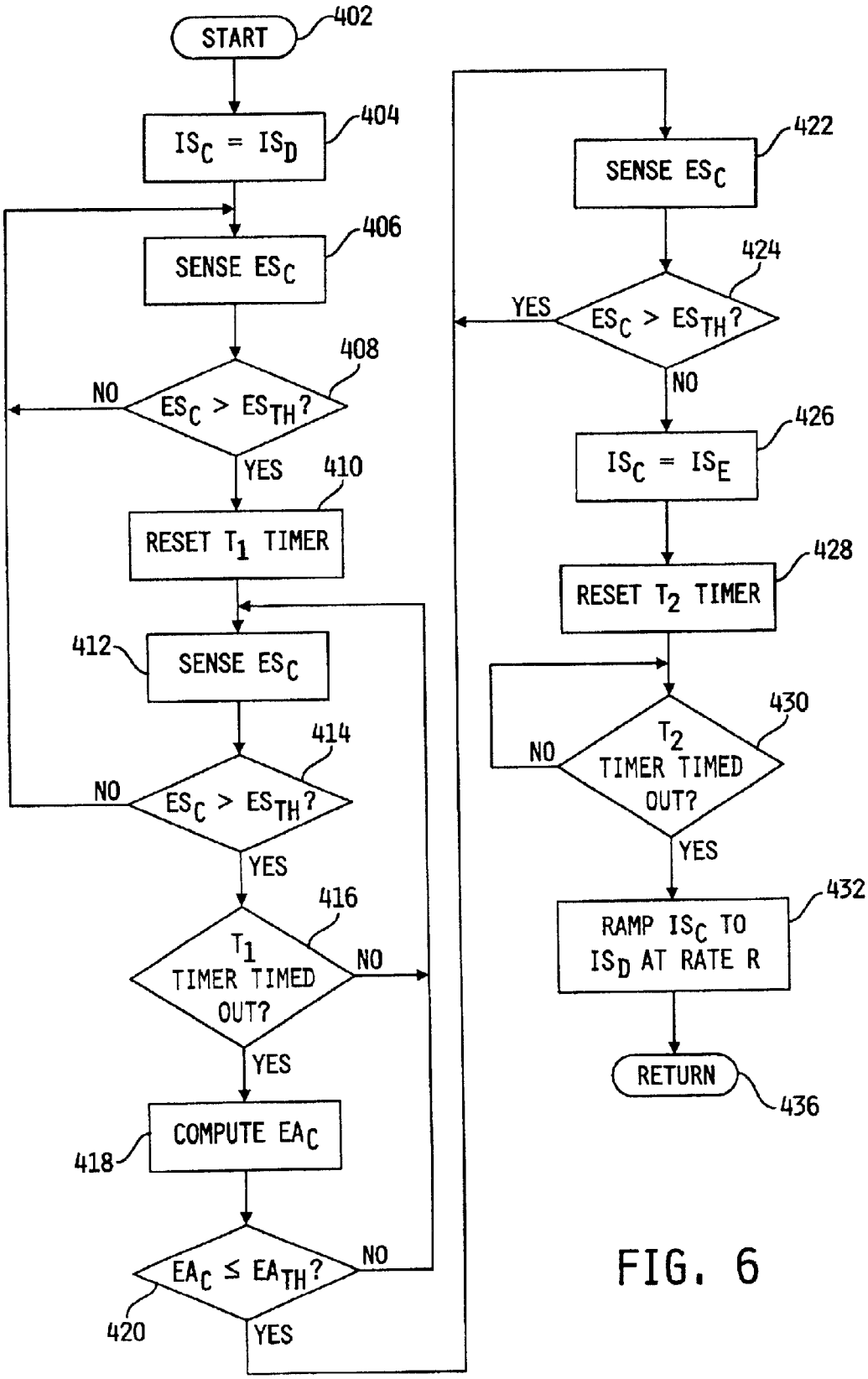
FIG. 6 is a flowchart illustrating one embodiment of a software algorithm for controlling the idle speed of an internal combustion engine, in accordance with the present invention.

Turning to FIG. 6, another preferred embodiment of the idle speed control strategy of the present invention will now be described. Shown in FIG. 6 is a flow chart illustrating a preferred embodiment of another software algorithm for controlling the idle speed of an internal combustion engine. In this preferred embodiment, the current acceleration (or deceleration) rate of engine 18 is calculated. This calculated acceleration rate is utilized in conjunction with the engine speed to determine the idle speed.

In one preferred embodiment, the algorithm is implemented inside idle speed governor 21. However, the algorithm could be implemented in any computational device coupled to control computer 10, such as a transmission control computer (not shown), without departing from the scope of the present invention.

The algorithm shown in FIG. 6 is an endless loop, which begins at step 402. At step 404, control computer 10 sets the current idle speed ($IS_C$) equal to the default idle speed ($IS_D$). It has been found that a suitable default idle speed is between 400 and 500 RPM for marine craft where engine 18 is a diesel engine. However, a suitable default idle speed ($IS_D$) will vary from engine to engine, and from application to application.

At step 406, control computer 10 determines the engine speed signal on signal path 28, as explained above in the description of FIG. 2. At step 408, control computer 10 determines whether the current engine speed ($ES_C$) is greater than a threshold engine speed ($ES_{TH}$). If the current engine speed ($ES_C$) is not greater than the threshold engine speed ($ES_{TH}$), the algorithm returns to step 406. However, if the current engine speed ($ES_C$) is greater than the threshold engine speed, the algorithm progresses to step 410.

At step 410, control computer 10 resets a first timer $T_1$ to zero or some other suitable reference. Timer $T_1$ may be any known type of timer capable of measuring the passage of time. At step 412, control computer 10 again determines the current engine speed ($ES_C$), in the same manner as in step 406. At step 414, control computer 10 determines whether the current engine speed ($ES_C$) is greater than the threshold engine speed ($ES_{TH}$), in the same manner as in step 408. If the current engine speed ($ES_C$) is not greater than the threshold engine speed ($ES_{TH}$), then the algorithm returns to step 406. However, if the current engine speed ($ES_C$) is greater than the threshold engine speed ($ES_{TH}$), then the algorithm progresses to step 416.

At step 416, control computer 10 determines whether timer $T_1$ has "timed out", or in other words measured a passage of time greater than a threshold passage of time. It has been found that a suitable threshold passage of time is about four seconds. However, a suitable time threshold may vary from engine to engine and from application to application. If control computer 10 determines at step 416 that timer $T_1$ has not timed out, the algorithm returns to step 412. However, if control computer 10 determines at step 416 that timer $T_1$ has timed out, the algorithm progresses to step 418.

At step 418, control computer 10 calculates the current engine acceleration ($EA_C$). In one preferred embodiment, control computer 10 is operable at step 418 to compute the current engine acceleration ($EA_C$) as the derivative of the current engine speed ($ES_C$), as that speed value is provided via the engine speed signal on signal path 28. Those skilled in the art will recognize that the current engine acceleration ($EA_C$) may alternatively be determined in accordance with other known techniques. For example, control computer 10 may alternatively determine the current engine speed ($ES_C$) as a known function of vehicle speed and transmission torque reduction, and then determine current engine acceleration ($EA_C$) as the derivative of this calculated engine speed. In this alternative embodiment, engine control system 1 of FIG. 1 will typically include a vehicle or craft speed sensor producing a vehicle speed signal indicating the road (or water) speed of the vehicle carrying engine 18, and will further be configured to determine a transmission torque reduction value in accordance with known techniques (e.g., via information provided by a transmission control computer). Those skilled in the art will recognize this and any other known techniques for determining engine acceleration, and any such other known techniques are intended to fall within the scope of the claims appended hereto.

At step 420, control computer 10 determines whether the current engine acceleration ($EA_C$) is less than or equal to a threshold engine deceleration rate ($EA_{TH}$). For example, in a marine application embodiment, a rapid engine deceleration indicates that the engine and transmission are being used to brake the marine craft travel, and possibly even reverse the direction of travel. In this case, if the current engine acceleration ($EA_C$) is greater than the threshold engine deceleration rate ($EA_{TH}$), the algorithm returns to step 412. However, if the current engine acceleration ($EA_C$) is less than or equal to the threshold engine deceleration rate ($EA_{TH}$), then the engine is decelerating at a rate greater than the threshold engine deceleration rate ($EA_{TH}$), and the algorithm proceeds to step 422.

At step 422, control computer 10 again determines the current engine speed ($ES_C$), as in step 406. The algorithm then progresses to step 424, where control computer 10 determines whether the current engine speed ($ES_C$) is greater than the threshold engine speed ($ES_{TH}$), as in step 408. If the current engine speed ($ES_C$) is greater than the threshold engine speed ($ES_{TH}$), then the algorithm returns to step 422. However, if the current engine speed ($ES_C$) is not greater than the threshold engine speed ($ES_{TH}$), the algorithm progresses to step 426.

At step 426, control computer 10 sets the current idle speed ($IS_C$) equal to an elevated idle speed ($IS_E$). It has been found that a suitable elevated idle speed is about 1000 RPM for marine craft where engine 18 is a diesel engine. However, a suitable elevated idle speed may vary from engine to engine and from application to application. This elevated idle speed ($IS_E$) will now be the idle speed value provided to by idle speed governor 41 to maximum function block 22, as described above in the description of FIG. 2. The algorithm next progresses to step 428.

At step 428, a second timer $T_2$ is reset; e.g. set to zero or another suitable reset value. Timer $T_2$ may be any known type of timer capable of measuring the passage of time. The algorithm then progresses to step 430, where control computer 10 determines whether timer $T_2$ has "timed out", or in other words, measured a passage of time greater than a threshold passage of time. If timer $T_2$ has not timed out, then the algorithm returns to step 130.

The if-then loop implemented in step 430 ensures that the current idle speed ($IS_C$) will remain at the elevated idle speed ($IS_E$) for the length of time determined by the time out period for timer $T_2$. It has been determined that a time period of about 10 seconds is suitable for this time period. However, a suitable time out period for timer $T_2$ may vary from engine to engine and from application to application.

After timer $T_2$ has timed out, the algorithm progresses to step 432. At step 432, the idle speed is ramped down from the elevated idle speed ($IS_E$) to the default idle speed ($IS_D$) at a suitable rate. It has been determined that one suitable rate is approximately 50 revolutions per minute (RPM) per second. However, this rate may vary from engine to engine and from application to application.

Once the current idle speed ($IS_C$) is returned to the default idle speed ($IS_D$), the algorithm progresses to step 436. At step 436, the algorithm returns to step 402, and repeats.

The illustrative embodiments described herein are exemplary, and are not intended to limit the claimed invention in any way. Although certain applications are described as specifically well suited for use with the current invention, it is believed to be useful in other applications as well. In fact, there are few, if any, internal combustion engine applications in which the present invention would not offer some benefit. Furthermore, the current invention will not require additional hardware for implementation in most computer based engine controllers. Therefore, engine and engine controller manufacturers may choose to include the present invention in all engines, irrespective of the application.

What is claimed is:

1. System for controlling idle speed of an internal combustion engine, the system comprising:

an engine speed sensor producing an engine speed signal indicative of a rotational engine speed of an internal combustion engine; and a control circuit controlling said rotational speed of said engine between an idle speed reference and a maximum speed reference, said control circuit modifying said idle speed reference as a function of said engine speed and a threshold engine speed value, wherein said threshold engine speed value is greater than said idle speed reference.

2. The system of claim 1 wherein said control circuit increases said idle speed reference from a first idle speed value to a second higher idle speed value as a function of said engine speed signal.

3. The system of claim 2 wherein said control circuit increases said idle speed reference to said second idle speed value if said engine speed signal indicates a rotational engine speed greater than a said threshold engine speed value for at least a first predefined time period.

4. The system of claim 3 wherein said control circuit increases said idle speed reference to said second idle speed value if said engine speed signal indicates a rotational engine speed less than said threshold engine speed subsequent to indicating for at least said first predefined time period a rotational engine speed greater than said threshold engine speed.

5. The system of claim 4 wherein said control circuit decreases said idle speed reference from said second idle speed value to said first idle speed upon the expiration of a second predefined time period.

6. The system of claim 5 wherein said control circuit decreases said idle speed reference from the second idle speed value to the first idle speed at a predetermined rate.

7. The system of claim 1 wherein said control circuit includes an engine speed control strategy, said engine speed control strategy comprising:

means for generating a reference engine speed as a function of a torque request;

means for generating said idle speed reference;

means for generating said maximum speed reference; and a speed governor configured to control said rotational engine speed of said engine between said idle speed reference and said maximum speed reference, said means for generating said idle speed reference responsive to said engine speed to modify said idle speed reference.

8. A method of controlling minimum rotational speed of an internal combustion engine, the method comprising the steps of:

determining rotational engine speed of an internal combustion engine;

determining an engine acceleration rate as a function of said rotational engine speed of said engine; and controlling a minimum rotational speed of said engine as a function of said rotational engine speed of said engine and said engine acceleration rate.

9. The method of claim 8 wherein controlling said minimum rotational speed of said engine includes increasing said minimum rotational speed from a first speed value to a second higher speed value if said rotational engine speed is greater than a threshold speed value and said engine acceleration rate is less than a predefined engine acceleration rate.

10. The method of claim 9 wherein controlling said minimum rotational speed of said engine includes increasing said minimum rotational speed from said first speed value to said second higher speed value if said rotational engine speed is greater than said threshold speed value for at least a first predefined time period.

11. The method of claim 10 wherein controlling said minimum rotational speed of said engine includes decreasing said minimum rotational speed from said second speed value to said first speed value upon the expiration of a second predefined time period.

12. The method of claim 11 wherein controlling said minimum rotational speed of said engine includes decreasing said minimum rotational speed from said second speed value to said first speed value at a predetermined rate.

13. System for controlling idle speed of an internal combustion engine, the system comprising:

an engine speed sensor producing an engine speed signal indicative of rotational speed of an internal combustion engine; and a control circuit controlling said rotational speed of said engine between an idle speed reference and a maximum speed reference, said control circuit temporarily increasing said idle speed reference from a first idle speed value to a second higher idle speed value if said engine speed signal drops from a threshold rotational speed value, wherein said threshold rotational speed value is greater than said idle speed reference.

14. The system of claim 13 wherein said control circuit is increases said idle speed reference from said first idle speed value to said second idle speed value for a predefined time period.

15. The system of claim 14 wherein said control circuit returns said idle speed reference to said first idle speed value upon expiration of said predefined time period.

16. A method of controlling idle speed of an internal combustion engine, the method comprising the steps of:

determining a rotational speed of an internal combustion engine;

controlling said rotational speed of said engine between an idle speed reference and a maximum speed reference; and temporarily increasing said idle speed reference from a first idle speed value to a second greater idle speed value if said rotational speed drops from above a threshold rotational speed value to below said threshold rotational speed value, wherein said threshold rotational soeed value is greater than said idle soeed reference.

17. The method of claim 16 wherein temporarily increasing said idle speed reference includes increasing said idle speed reference from said first idle speed value to said second idle speed value if said rotational speed is greater than said threshold rotational speed value for at least a first predefined time period.

18. The method of claim 17 wherein temporarily increasing said idle speed reference includes decreasing said idle speed reference from said second idle speed value to said first idle speed value upon the expiration of a second predefined time period.

19. The method of claim 18 wherein temporarily increasing said idle speed reference includes decreasing said idle speed reference from said second idle speed value to said first idle speed value at a predetermined rate.

20. The system of claim 19 wherein said first predefined time period is approximately ten seconds and said second predefined time period is approximately four seconds.

* * * * *